US010205215B2

(12) United States Patent
Miyoshi et al.

(10) Patent No.: US 10,205,215 B2
(45) Date of Patent: Feb. 12, 2019

(54) VEHICLE

(71) Applicant: NIDEC ELESYS CORPORATION, Kawasaki-shi, Kanagawa (JP)

(72) Inventors: Akito Miyoshi, Kawasaki (JP); Hiroyuki Kamo, Kawasaki (JP); Masahiro Shindo, Kawasaki (JP)

(73) Assignee: NIDEC CORPORATION, Kyoto (JP)

( * ) Notice: Subject to any disclaimer, the term of this patent is extended or adjusted under 35 U.S.C. 154(b) by 155 days.

(21) Appl. No.: 15/455,168

(22) Filed: Mar. 10, 2017

(65) Prior Publication Data

US 2017/0263999 A1 Sep. 14, 2017

(30) Foreign Application Priority Data

Mar. 11, 2016 (JP) ..... 2016-047838

(51) Int. Cl.

| | |
|---|---|
| ***H01Q 1/32*** | (2006.01) |
| ***H01Q 1/12*** | (2006.01) |
| ***H01Q 3/06*** | (2006.01) |
| ***H01Q 9/04*** | (2006.01) |

(52) U.S. Cl.

CPC ..... *H01Q 1/1271* (2013.01); *H01Q 1/3275* (2013.01); *H01Q 1/3291* (2013.01); *H01Q 3/06* (2013.01); *H01Q 9/0485* (2013.01)

(58) Field of Classification Search

CPC .. H01Q 1/1271; H01Q 1/3275; H01Q 1/3291; H01Q 3/06; H01Q 9/0485

See application file for complete search history.

(56) References Cited

U.S. PATENT DOCUMENTS

| | | | | |
|---|---|---|---|---|
| 2,659,884 A | | 11/1953 | McMillan et al. | |
| 3,002,190 A | | 9/1961 | Oleesky et al. | |
| 3,780,374 A | | 12/1973 | Shibano et al. | |
| 4,179,699 A | | 12/1979 | Lunden | |
| 4,677,443 A | | 6/1987 | Koetje et al. | |
| 4,725,475 A | | 2/1988 | Fiscus et al. | |
| 5,017,939 A | * | 5/1991 | Wu | H01Q 1/422 343/753 |
| 5,408,244 A | | 4/1995 | Mackenzie | |
| 6,028,565 A | | 2/2000 | Mackenzie et al. | |
| 7,460,054 B2 | | 12/2008 | Kim et al. | |

(Continued)

FOREIGN PATENT DOCUMENTS

EP 0 888 646 B1 3/2000

*Primary Examiner* — Dameon E Levi
*Assistant Examiner* — Jennifer F Hu
(74) *Attorney, Agent, or Firm* — Keating & Bennett, LLP

(57) ABSTRACT

A vehicle includes a vehicle body, a drive mechanism, a windshield, an antenna part provided in a vehicle interior, and a reflection suppression layer including a dielectric layer that closely adheres to a surface on the antenna part side of the windshield. The dielectric layer has a refractive index that is lower than a refractive index of a glass layer of the windshield and higher than a refractive index of air. The dielectric layer has a thickness that allows reflection of the transmission wave to be suppressed by interference between a reflected wave generated by reflection of the transmission wave on an interface on the opposite side of the innermost glass layer of the windshield to the antenna part side, and a reflected wave generated by reflection of the transmission wave on a surface on the antenna part side of the dielectric layer.

20 Claims, 5 Drawing Sheets

(56) References Cited

U.S. PATENT DOCUMENTS

| | | | | |
|---|---|---|---|---|
| 7,918,570 | B2 * | 4/2011 | Weller | B60R 1/12 359/879 |
| 8,063,753 | B2 * | 11/2011 | DeLine | B60K 35/00 340/425.5 |
| 8,604,968 | B2 * | 12/2013 | Alland | B60R 1/00 342/70 |
| 8,614,640 | B2 * | 12/2013 | Lynam | B60T 7/22 342/52 |
| 9,799,949 | B2 * | 10/2017 | Kamo | H01Q 1/3266 |
| 2006/0034002 | A1 * | 2/2006 | Troxell | B60R 1/00 359/737 |
| 2010/0039346 | A1 | 2/2010 | Peter et al. | |
| 2010/0214194 | A1 * | 8/2010 | Kanou | B32B 17/10036 345/4 |
| 2011/0163904 | A1 * | 7/2011 | Alland | B60R 1/00 342/1 |
| 2014/0118179 | A1 * | 5/2014 | Alland | G01S 7/025 342/22 |
| 2016/0093944 | A1 * | 3/2016 | Kamo | H01Q 1/3266 348/148 |
| 2017/0207513 | A1 * | 7/2017 | Miyoshi | H01Q 1/1271 |
| 2017/0207514 | A1 * | 7/2017 | Kamo | G01S 13/931 |

* cited by examiner

VEHICLE

TECHNICAL FIELD

The present invention relates to a vehicle having an antenna part in the interior.

BACKGROUND ART

There are automobiles in which an antenna for radiating radar waves and receiving reflected waves is mounted at the front nose or in the vicinity of the rear gate. However, these parts of the automobiles are the first to be deformed or damaged in cases of collisions with other vehicles or objects, even if the collisions are minor ones, and a radar mounted on such parts is also highly likely to be damaged. The radar is a device that is necessary to ensure the safety of automobiles, and it is not desirable for the radar to lose its functionality due to minor collisions. This is all the more so if automatic driving is put into practical use.

Such undesirable situations are less likely to occur if the radar device is mounted in the interior of a vehicle, but in that case, the radar device needs to transmit and receive radar waves through the windshield including glass. In this case, the reflection and absorption of the waves by the glass are unavoidable, and the radar will have limited detection capabilities.

European Patent No. 888646 discloses a method in which, when a communication antenna is installed in the interior of a vehicle, an intermediate dielectric member is disposed between glass and the radiating surface of the antenna in order to suppress the reflection of a radio wave by the glass. According to European Patent No. 888646, the electrically effective distance between the glass and the antenna is adjusted to several times the half-wavelength of the wave.

Incidentally, the thickness of the glass affects reflection from the entire glass, the reflection being an overlap of reflected waves from the front surface of the glass and from the rear surface of the glass. However, it is not usually possible to freely select the thickness of the glass of the windshield. Thus, the influence of the reflected wave from the rear surface of the glass has not been considered thus far.

SUMMARY OF INVENTION

The present invention is intended for a vehicle, and it is an object of the present invention to reduce loss of a transmission wave passing through the windshield in consideration of a reflected wave from the rear surface of glass of a windshield.

An exemplary vehicle according to the present invention includes a vehicle body, a drive mechanism for moving the vehicle body, a windshield located between a vehicle interior and an outside, at least a surface on the vehicle interior side of the windshield being a surface of a glass layer, an antenna part provided in the vehicle interior and for transmitting a transmission wave from the vehicle interior through the windshield to the outside, the transmission wave being a radio wave in a millimeter waveband, and receiving a reflected wave that enters the vehicle interior from the outside through the windshield, a reflection suppression layer composed of at least one dielectric layer that closely adheres to the surface on the antenna part side of the windshield, a high-frequency oscillator for outputting high-frequency electric power to the antenna part, and a receiver for receiving input of a radio wave received by the antenna part and outputting a received signal.

The at least one dielectric layer has a refractive index that is lower than a refractive index of the glass layer and higher than a refractive index of air. The transmission wave has a horizontal polarization component greater than a vertical polarization component thereof with respect to the reflection suppression layer, Formula 1 is satisfied:

$$\frac{\lambda}{2}\left(M+\frac{5}{8}\right) > d_g\sqrt{n_g^2 - n_i^2 \sin^2\theta_i} > \frac{\lambda}{2}\left(M+\frac{3}{8}\right) \quad \text{[Formula 1]}$$

and $$\frac{\lambda}{2}\left(N+\frac{9}{8}\right) > d_g\sqrt{n_g^2 - n_i^2 \sin^2\theta_i} + \sum_{j=1}^{m} d_{sj}\sqrt{n_{sj}^2 - n_i^2 \sin^2\theta_i} > \frac{\lambda}{2}\left(N+\frac{7}{8}\right)$$

where $\theta_i$ is an incident angle of the transmission wave on the reflection suppression layer at a center of a main lobe, $n_i$ is the refractive index of air, m is the number of the at least one dielectric layer, $d_{sj}$ is a thickness of a j-th dielectric layer counting from the antenna part side, $n_{sj}$ is a refractive index of the j-th dielectric layer, $d_g$ is a thickness of the glass layer, $n_g$ is a refractive index of the glass layer, $\lambda$ is a wavelength of the transmission wave in air, and M and N are integers of 0 or more.

Another exemplary vehicle according to the present invention includes a vehicle body, a drive mechanism for moving the vehicle body, a windshield located between a vehicle interior and an outside, at least a surface on the vehicle interior side of the windshield being a surface of a glass layer, an antenna part provided in the vehicle interior and for transmitting a transmission wave from the vehicle interior through the windshield to the outside, the transmission wave being a radio wave in a millimeter waveband, and receiving a reflected wave that enters the vehicle interior from the outside through the windshield, a reflection suppression layer composed of at least one dielectric layer that closely adheres to the surface on the antenna part side of the windshield, a high-frequency oscillator for outputting high-frequency electric power to the antenna part, and a receiver for receiving input of a radio wave received by the antenna part and outputting a received signal.

The at least one dielectric layer has a refractive index that is lower than a refractive index of the glass layer and higher than a refractive index of air. The transmission wave has a vertical polarization component greater than a horizontal polarization component thereof with respect to the reflection suppression layer.

Formulas 2 and 3 are satisfied:

If $\theta_i$ is greater than or smaller than both of $\sin^{-1}\left(\frac{n_r n_g}{n_i\sqrt{n_g^2+n_r^2}}\right)$ and $\tan^{-1}\frac{n_{s1}}{n_i}$, [Formula 2]

$$\frac{\lambda}{2}\left(M+\frac{5}{8}\right) > d_g\sqrt{n_g^2 - n_i^2 \sin^2\theta_i} > \frac{\lambda}{2}\left(M+\frac{3}{8}\right)$$

and $$\frac{\lambda}{2}\left(N+\frac{9}{8}\right) > d_g\sqrt{n_g^2 - n_i^2 \sin^2\theta_i} + \sum_{j=1}^{m} d_{sj}\sqrt{n_{sj}^2 - n_i^2 \sin^2\theta_i} > \frac{\lambda}{2}\left(N+\frac{7}{8}\right)$$

-continued

If $\theta_i$ is a value between or equal to one of [Formula 3]

$$\sin^{-1}\left(\frac{n_r n_g}{n_i\sqrt{n_g^2+n_r^2}}\right) \text{ and } \tan^{-1}\frac{n_{s1}}{n_i},$$

$$\frac{\lambda}{2}\left(M+\frac{9}{8}\right) > d_g\sqrt{n_g^2-n_i^2\sin^2\theta_i} > \frac{\lambda}{2}\left(M+\frac{7}{8}\right)$$

and $$\frac{\lambda}{2}\left(N+\frac{5}{8}\right) > d_g\sqrt{n_g^2-n_i^2\sin^2\theta_i} + \sum_{j=1}^{m} d_{sj}\sqrt{n_{sj}^2-n_i^2\sin^2\theta_i} > \frac{\lambda}{2}\left(N+\frac{3}{8}\right)$$

where $\theta_i$ is an incident angle of the transmission wave on the reflection suppression layer at a center of a main lobe, $n_i$ is a refractive index of air, m is the number of the at least one dielectric layer, $d_{sj}$ is a thickness of a j-th dielectric layer counting from the antenna part side, $n_{sj}$ is a refractive index of the j-th dielectric layer, $d_g$ is a thickness of the glass layer, $n_g$ is a refractive index of the glass layer, $n_r$ is a refractive index of a dielectric layer or an air layer that is adjacent to an opposite side of the glass layer to the antenna part side, $\lambda$ is a wavelength of the transmission wave in air, and M and N are integers of 0 or more.

According to the present invention, it is possible to reduce loss of the transmission wave passing through the windshield.

These and other objects, features, aspects and advantages of the present invention will become more apparent from the following detailed description of the present invention when taken in conjunction with the accompanying drawings.

DESCRIPTION OF EMBODIMENTS

Figure 1:
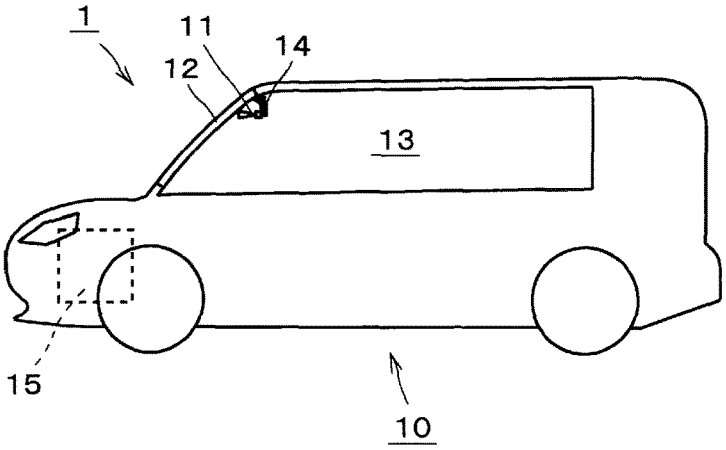
FIG. 1 is a simplified side view of a vehicle.

FIG. 1 is a simplified side view of a vehicle 1 according to an exemplary embodiment of the present invention. The vehicle 1 is a passenger car and includes an on-vehicle radar device 11 (hereinafter, referred to as a "radar device").

The radar device 11 is used for purposes such as collision avoidance, driving assistance, and automatic driving. The radar device 11 is mounted on the inner surface of a windshield 12 of the vehicle 1 and located in a vehicle interior 13. The vehicle interior 13 does not need to be a completely isolated space separated from the outside, and may be open-roofed, for example. The radar device 11 is located forward of a rear-view mirror 14 mounted on the windshield 12. The vehicle 1 includes a vehicle body 10 and a drive mechanism 15 for moving the vehicle body 10. The drive mechanism 15 includes, for example, an engine, a steering mechanism, a power transmission mechanism, and wheels.

The windshield 12 is fixed to the vehicle body 10 and located between the vehicle interior 13 and the outside. The windshield 12 is laminated glass in which a film is sandwiched between two sheets of glass. The radar device 11 is fixed to the inner surface of the windshield 12 either directly or indirectly via a mounting member such as a bracket. As another form of mounting, the radar device 11 may be mounted on the rear-view mirror or the ceiling. In the present embodiment, the radar device 11 is indirectly fixed to the windshield 12 via a bracket.

Figure 2:
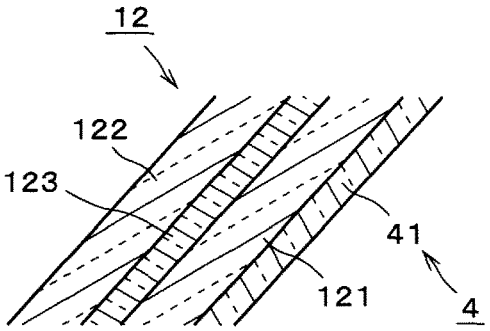
FIG. 2 is a cross-sectional view of a windshield.

As illustrated in FIG. 2, the windshield 12 includes an innermost glass layer 121, an outermost glass layer 122, and an intermediate resin layer 123. The intermediate resin layer 123 is sandwiched between the innermost glass layer 121 and the outermost glass layer 122. That is, the innermost glass layer 121, the intermediate resin layer 123, and the outermost glass layer 122 are arranged in the stated order when viewed from the vehicle interior 13. The windshield 12 may adopt other structures as long as the surface on the vehicle interior 13 side of the windshield 12 is a surface of a glass layer, i.e., at least the surface on the vehicle interior 13 side of the windshield 12 is a surface of covering glass.

The windshield 12 has a reflection suppression layer 4 on the surface on the vehicle interior 13 side. The reflection suppression layer 4 includes a sheet-like dielectric layer 41. The details of the dielectric layer 41 will be described later. In the present embodiment, the innermost glass layer 121 and the outermost glass layer 122 are made of soda-lime glass. The innermost glass layer 121 and the outermost glass layer 122 may have the same optical properties, or may have different optical properties. The intermediate resin layer 123 is preferably made of polyvinyl butyrate (PVB). The intermediate resin layer 123 may include a plurality of resin layers stacked on top of one another.

Figure 3:
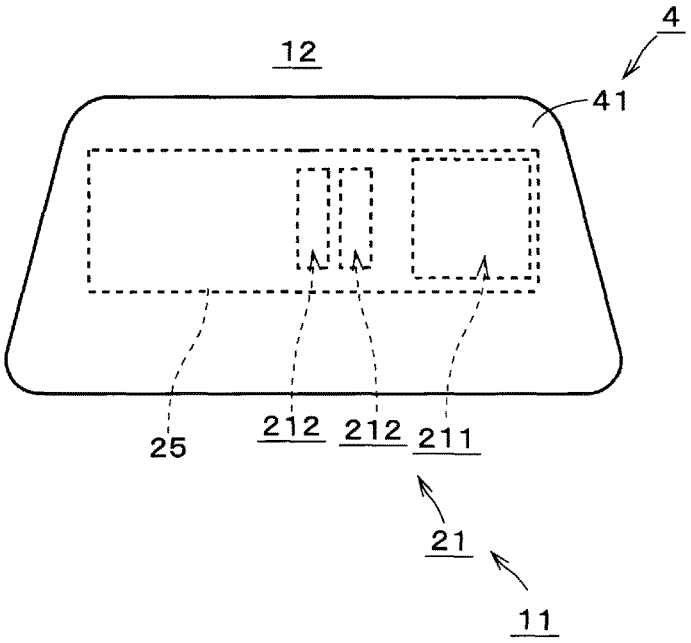
FIG. 3 is a front view of the windshield.
Figure 4:
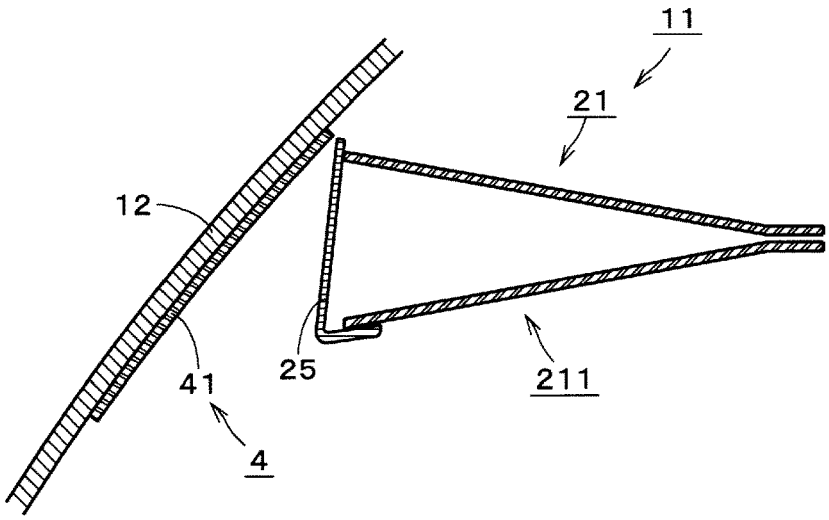
FIG. 4 is a cross-sectional view of a radar device, the windshield, and a reflection suppression layer.

FIGS. 3 and 4 illustrate part of the radar device 11 mounted on the windshield 12 and the reflection suppression layer 4. FIG. 3 illustrates the vehicle interior 13 as viewed from the front side of the windshield 12. FIG. 4 illustrates cross-sections of the radar device 11, the windshield 12, and the reflection suppression layer 4 that are approximately perpendicular to the windshield 12. In FIG. 4, the windshield 12 is illustrated as a single layer without distinguishing among the innermost glass layer 121, the intermediate resin layer 123, and the outermost glass layer 122.

The dielectric layer 41 is bonded to the surface on the vehicle interior 13 side of the windshield 12, i.e., the surface on an antenna part 21 (described later) side of the windshield 12, and closely adheres to that surface. The dielectric layer 41 covers only part of the windshield 12. The width of the dielectric layer 41 along the surface of the windshield 12 increases in the downward direction. The dielectric layer 41 is an amorphous resin sheet and made of, for example, modified polyphenylene ether (PPE). The dielectric layer 41 may be made of other materials. The dielectric layer 41 is preferably transparent if the radar device 11 includes a camera. If there is no interference with the function of the radar device 11, the dielectric layer 41 may be opaque.

As described previously, the radar device 11 is fixed to the windshield 12 via a bracket (not shown). The radar device 11 is detachable from the bracket. The radar device 11 includes an antenna part 21 and an antenna cover 25. The antenna part 21 transmits a radio wave, which is a radar wave, from the vehicle interior 13 through the windshield 12 to the outside and receives a reflected wave that enters the vehicle interior 13 from the outside through the windshield 12.

The antenna part 21 includes a transmitting antenna 211 and a plurality of receiving antennas 212. The transmitting antenna 211 transmits a transmission wave that is a radio wave in the millimeter waveband. Each receiving antenna 212 receives a reflected wave resulting from the transmission wave. The transmitting antenna 211 and the receiving antennas 212 may be horn antennas. The transmitting antenna 211 and the receiving antennas 212 may also be antennas other than horn antennas. That is, the transmitting antenna 211 and the receiving antennas 212 may be any antennas that can transmit and receive millimeter waves. The transmitting antenna 211 is preferably disposed such that the direction of the center of the main lobe, i.e., the direction of the peak of the main lobe, is oriented in the horizontal direction. While in the example in FIG. 3, the antenna part 21 includes two receiving antennas 212, the antenna part 21 may include three or more receiving antennas 212. The antenna part 21 may also include a plurality of transmitting antennas 211. As another alternative, one antenna may serve as both a transmitting antenna and a receiving antenna.

In each horn antenna of the antenna part 21, constituents are electrically or spatially connected for transmitting and receiving signals in the order of a monolithic microwave integrated circuit (MMIC), a transmission line (specifically, a microstrip line, a transducer, and a waveguide), and a horn. Using the horn antenna allows gains to be secured while minimizing the width in the height direction of the antenna and allows the forward projection area of the radar device 11 to be reduced. Thus, the radar device 11 can be installed in the vicinity of the windshield without limiting the vision of passengers.

The antenna cover 25 is located between the windshield 12 and the antenna part 21 and covers the front of the antenna part 21. The antenna cover 25 is molded of a resin. The front surface, i.e., outer surface, of the antenna cover 25 is black in color. This prevents the antenna part 21 from standing out when viewed from the outside of the vehicle, and ensures the aesthetic appearance of the vehicle 1. The antenna cover 25 is also called a "Radome."

Figure 5:
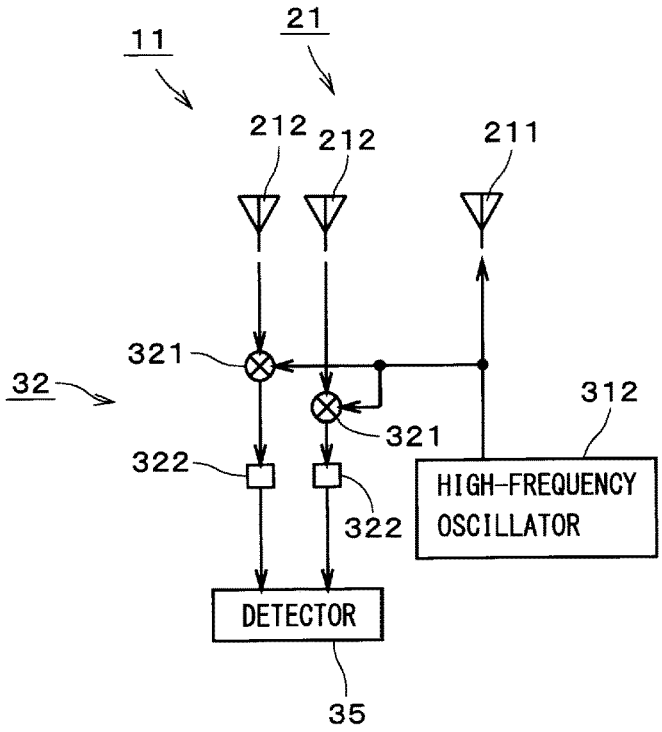
FIG. 5 is a block diagram illustrating an outline of a configuration of the radar device.

FIG. 5 is a block diagram illustrating an outline of a configuration of the radar device 11. The radar device 11 further includes a high-frequency oscillator 312, a receiver 32, and a detector 35. The receiver 32 includes mixers 321 and analog-to-digital (A/D) converters 322. The transmitting antenna 211 is connected to the high-frequency oscillator 312. The high-frequency oscillator 312 outputs high-frequency electric power to the transmitting antenna 211, and accordingly the transmitting antenna 211 transmits a transmission wave. Here, the transmission wave has a vertical polarization component greater than a horizontal polarization component thereof with respect to the reflection suppression layer 4.

Each receiving antenna 212 is sequentially connected to a mixer 321 and an A/D converter 322. The A/D converter 322 is connected to the detector 35. The receiving antenna 212 receives a reflected wave generated by reflection of a transmission wave on an object outside the vehicle. A radio wave signal received by the receiving antenna 212 is input to the mixer 321. The mixer 321 also receives input of a signal from the high-frequency oscillator 312 and combines these received signals to acquire a beat signal that indicates a difference in frequency between the transmission wave and the reflected wave. The beat signal is converted into a digital signal by the A/D converter 322 and is output as a received signal to the detector 35. The detector 35 obtains, for example, the position and speed of the object by converting the beat signals through Fourier transformation and further performing arithmetic processing on the signals.

Figure 6:
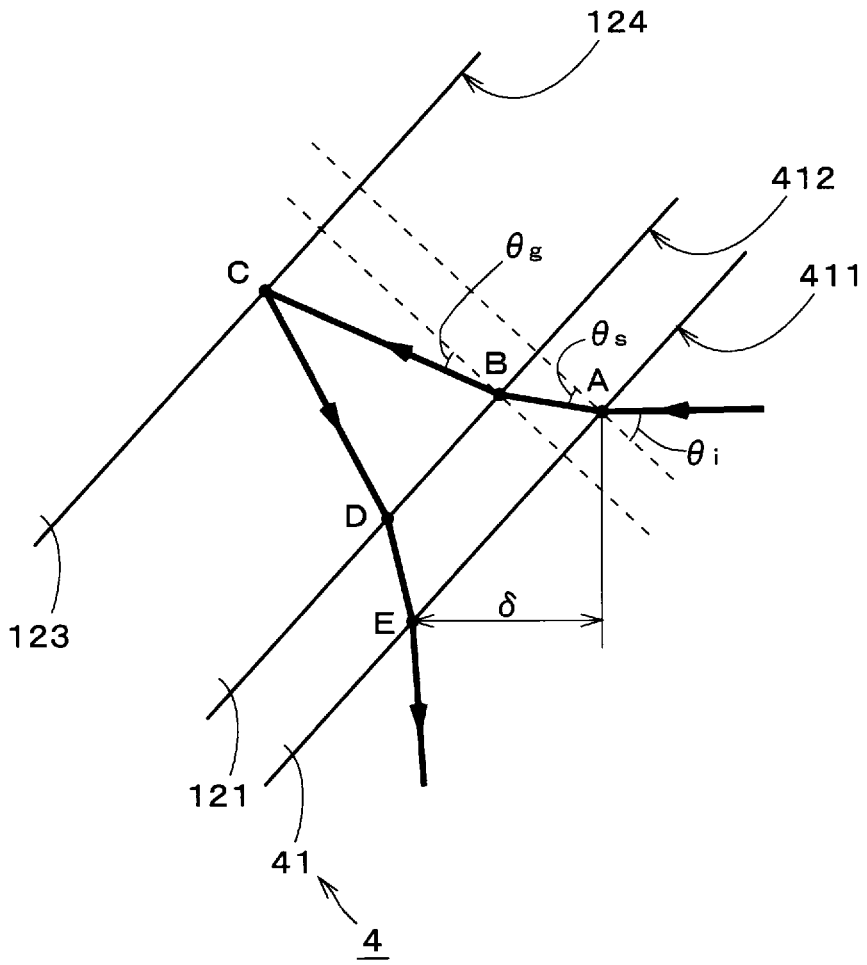
FIG. 6 illustrates a state in which a transmission wave enters the reflection suppression layer and an innermost glass layer.

Next, the details of the reflection suppression layer 4 will be described. FIG. 6 illustrates a state in which a transmission wave enters the reflection suppression layer 4 and the innermost glass layer 121 (see FIG. 2) of the windshield 12. Note that the incident angle of the transmission wave refers to an incident angle of the transmission wave on an object at the center of the main lobe of the transmitting antenna 211.

Here, the refractive index of the reflection suppression layer 4 in FIG. 6, i.e., the refractive index of the dielectric layer 41, is lower than the refractive index of the innermost glass layer 121 and higher than the refractive index of the air. Thus, the reflectivity of a surface 411 on the antenna part 21 side of the dielectric layer 41 will be reduced to some extent, as compared to the reflectivity of the surface on the antenna part 21 side of the windshield 12 on the condition that no dielectric layer 41 is included in the windshield 12. The refractive index of the dielectric layer 41 may be adjusted by introducing air bubbles or other materials.

Focusing now on the transmission wave that enters the dielectric layer 41 and the innermost glass layer 121 and is then reflected at the boundary between the innermost glass layer 121 and the intermediate resin layer 123, the transmission wave entering the dielectric layer 41 from a point A on the surface 411 enters the innermost glass layer 121 at a point B on an interface 412 between the dielectric layer 41 and the windshield 12 as indicated by bold arrows in FIG. 6. The transmission wave is reflected at a point C on an interface 124 between the innermost glass layer 121 and the intermediate resin layer 123 and returns as a reflected wave to a point D on the interface 412. The reflected wave entering the dielectric layer 41 from the point D returns to a point E on the surface 411 and travels from the point E toward the vehicle interior. To be precise, the passage and reflection of a radio wave at the interfaces and surfaces described above indicate the passage and reflection of part of the radio wave.

If the reflected wave passing through the point E and a transmission wave entering the point E on the surface 411 from the antenna part 21 side and reflected are opposite in phase (i.e., the phases of the reflected wave and the transmission wave are shifted by $\pi$), they will cancel out each other. As a result, the reflection of the transmission wave on the surface 411, the transmission wave being incident on and reflected off the surface 411, will be suppressed.

The following describes the dielectric layer 41 that suppresses the reflection of a transmission wave by interference between a reflected wave generated by reflection of the transmission wave on the interface 124 and the transmission wave reflected on the surface 411 (i.e., reflected wave generated by reflection of the transmission wave on the surface 411). In the following description, $\theta_i$ is the incident angle of the transmission wave on the dielectric layer 41, $\theta_s$ is the refraction angle of the transmission wave in the dielectric layer 41, $\theta_g$ is the refraction angle of the transmission wave in the innermost glass layer 121, $n_i$ is the reflective index of the air, $d_s$ is the thickness of the dielectric layer 41, $n_s$ is the refractive index of the dielectric layer 41, $d_g$ is the thickness of the innermost glass layer 121, $n_g$ is the refractive index of the innermost glass layer 121, and $\lambda$ is the wavelength of the transmission wave in the air. First, an optical path length $L_{a-e}$ from the point A through the points B, C, and D to the point E is expressed by Formula 4.

$$L_{a-e} = 2\left(\frac{d_s n_s}{\cos\theta_s} + \frac{d_g n_g}{\cos\theta_g}\right) \quad \text{[Formula 4]}$$

An optical path length δ between the point A and the point E in the travel direction of the transmission wave, which enters the dielectric layer 41 from the antenna part 21, is expressed by Formula 5.

$$\delta = 2n_i(d_s \tan\theta_s + d_g \tan\theta_g)\sin\theta_i \quad \text{[Formula 5]}$$

When the transmission wave has a horizontal polarization component greater than the vertical polarization component thereof with respect to the reflection suppression layer 4 (i.e., when the direction of an electric field is parallel to the windshield 12), the horizontal polarization component of the transmission wave becomes the dominant feature over the windshield 12 and the reflection suppression layer 4. In this case, the condition for causing the reflected wave generated by reflection of the transmission wave on the interface 124 and the transmission wave reflected on the surface 411 to become opposite in phase on the surface 411 is expressed by Formula 6, where N is an integer of 0 or more. The refractive indices of an air layer and the intermediate resin layer 123 are lower than the refractive index $n_g$ of the innermost glass layer 121. Formula 6 is based on the phases inversion (i.e., the phases are shifted by π) by the reflection of the transmission wave entering the point E from the air layer.

$$L_{a-e} = (N+1)\lambda + \delta \quad \text{[Formula 6]}$$

Substituting Formulas 4 and 5 in Formula 6 yields Formula 7.

$$2\left(\frac{d_s n_s}{\cos\theta_s} + \frac{d_g n_g}{\cos\theta_g}\right) = (N+1)\lambda + 2n_i(d_s \tan\theta_s + d_g \tan\theta_g)\tan\theta_s \sin\theta_i \quad \text{[Formula 7]}$$

Formula 7 is transformed into Formula 8 and then into Formula 9.

$$\frac{d_s n_s}{\cos\theta_s} + \frac{d_g n_g}{\cos\theta_g} - (d_s \tan\theta_s + d_g \tan\theta_g)n_i \sin\theta_i = \frac{\lambda}{2}(N+1) \quad \text{[Formula 8]}$$

$$\frac{d_s n_s}{\sqrt{1-\sin^2\theta_s}} + \frac{d_g n_g}{\sqrt{1-\sin^2\theta_g}} - \left(\frac{d_s \sin\theta_s}{\sqrt{1-\sin^2\theta_s}} + \frac{d_g \sin\theta_g}{\sqrt{1-\sin^2\theta_g}}\right)n_i \sin\theta_i = \frac{\lambda}{2}(N+1) \quad \text{[Formula 9]}$$

Formula 9 is expressed by Formula 10 according to Snell's law and further transformed into Formula 11 to ultimately yield Formula 12.

$$\frac{d_s n_s}{\sqrt{1-\frac{n_i^2}{n_s^2}\sin^2\theta_i}} + \frac{d_g n_g}{\sqrt{1-\frac{n_s^2 n_i^2}{n_g^2 n_s^2}\sin^2\theta_i}} - \left(\frac{d_s \frac{n_i}{n_s}\sin\theta_i}{\sqrt{1-\frac{n_i^2}{n_s^2}\sin^2\theta_i}} + \frac{d_g \frac{n_s}{n_g}\frac{n_i}{n_s}\sin\theta_i}{\sqrt{1-\frac{n_s^2 n_i^2}{n_g^2 n_s^2}\sin^2\theta_i}}\right)n_i \sin\theta_i = \frac{\lambda}{2}(N+1) \quad \text{[Formula 10]}$$

$$\frac{d_s n_s^2}{\sqrt{n_s^2 - n_i^2 \sin^2\theta_i}} + \frac{d_g n_g^2}{\sqrt{n_g^2 - n_i^2 - \sin^2\theta_i}} - \left(\frac{d_s n_i^2 \sin^2\theta_i}{\sqrt{n_s^2 - n_i^2 \sin^2\theta_i}} + \frac{d_g n_i^2 \sin^2\theta_i}{\sqrt{n_g^2 - n_i^2 \sin^2\theta_i}}\right) = \frac{\lambda}{2}(N+1) \quad \text{[Formula 11]}$$

$$d_s\sqrt{n_s^2 - n_i^2 \sin^2\theta_i} + d_g\sqrt{n_g^2 - n_i^2 \sin^2\theta_i} = \frac{\lambda}{2}(N+1) \quad \text{[Formula 12]}$$

If the phase shift between the reflected wave generated by reflection of the transmission wave on the interface 124 and the transmission wave reflected on the surface 411 is within a range of (π±π/8), it is considered possible to suppress the reflection of the transmission wave on the surface 411 of the dielectric layer 41. In this case, a preferable condition for the thickness $d_s$ and refractive index $n_s$ of the dielectric layer 41 corresponding to the incident angle $\theta_i$ of the transmission wave on the dielectric layer 41 (i.e., the tilt angle of the windshield 12) is expressed by Formula 13.

$$\frac{\lambda}{2}\left(N + \frac{9}{8}\right) > d_s\sqrt{n_s^2 - n_i^2 \sin^2\theta_i} + d_g\sqrt{n_g^2 - n_i^2 \sin^2\theta_i} > \frac{\lambda}{2}\left(N + \frac{7}{8}\right) \quad \text{[Formula 13]}$$

Figure 7:
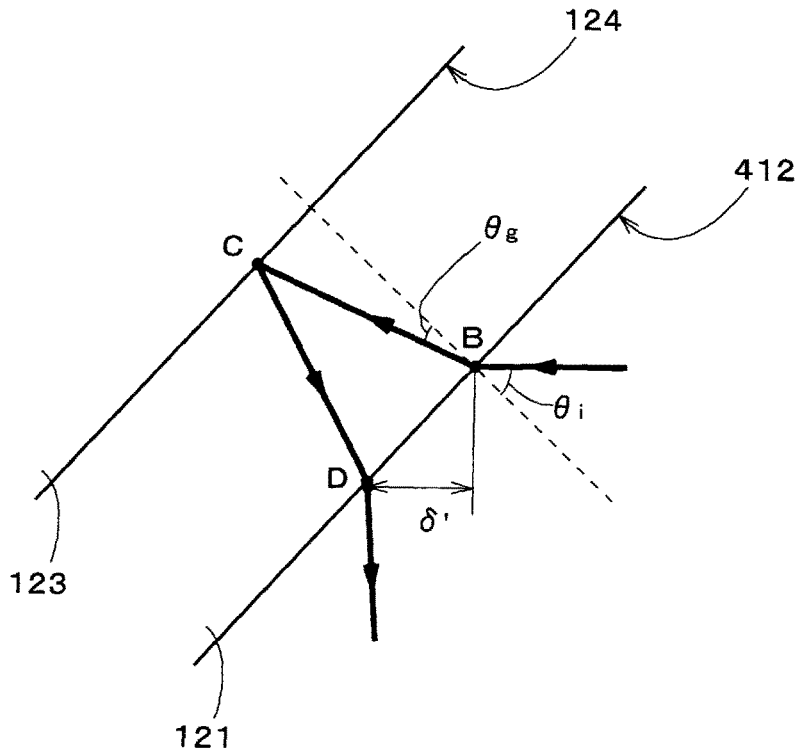
FIG. 7 illustrates a state in which a transmission wave enters the innermost glass layer in the case where there is no reflection suppression layer.

The above condition is suitable for the case where the thickness $d_g$ of the innermost glass layer 121 acts to the disadvantage thereof in suppressing reflection by only the presence of the innermost glass layer 121 when there is no dielectric layer 41. In this case, an optical path length $L_{b-d}$ from the point B through the point C to the point D and an optical path length δ' between the point B and the point D in the travel direction of the transmission wave, as illustrated in FIG. 7, have a relationship expressed by Formula 14, where M is an integer of 0 or more.

$$L_{b-d} = \frac{\lambda}{2}(2M+1) + \delta' \quad \text{[Formula 14]}$$

When Formula 14 is transformed according to Formula 6 and a π/8 shift in wavelength is tolerable, the thickness $d_g$ of the innermost glass layer 121 satisfies Formula 15.

$$\frac{\lambda}{2}\left(M + \frac{5}{8}\right) > d_g\sqrt{n_g^2 - n_i^2 \sin^2\theta_i} > \frac{\lambda}{2}\left(M + \frac{3}{8}\right) \quad \text{[Formula 15]}$$

From the foregoing, when the thickness $d_g$ and refractive index $n_g$ of the innermost glass layer 121 satisfy Formula 15 and the transmission wave has a horizontal polarization component greater than the vertical polarization component thereof with respect to the reflection suppression layer 4, the thickness $d_s$ and refractive index $n_s$ of the dielectric layer 41 preferably satisfy Formula 13. In this case, the reflection of the transmission wave will be suppressed by interference between the reflected wave generated by reflection of the transmission wave on the interface 124 and the reflected wave generated by reflection of the transmission wave on the surface 411.

When the transmission wave has a vertical polarization component greater than the horizontal polarization component thereof with respect to the reflection suppression layer 4 (i.e., when the direction of an electric field is parallel to the plane of incidence on the windshield 12), the vertical polarization component of the transmission wave becomes the dominant feature over the windshield 12 and the reflection suppression layer 4. In this case, the condition required for $L_{a-e}$ changes with the magnitude relation between the refraction angle $\theta_g$ and a Brewster angle corresponding to the refraction angle $\theta_g$ and the magnitude relation between the incident angle $\theta_i$ and a Brewster angle corresponding to the incident angle $\theta_i$.

The Brewster angle $\theta_{ib}$ corresponding to the incident angle $\theta_i$ is expressed by Formula 16.

$$\theta_{ib} = \tan^{-1}\frac{n_s}{n_i} \quad \text{[Formula 16]}$$

The incident angle $\theta_i$ (hereinafter, expressed as "$\theta_{igb}$") with which the Brewster angle $\theta_{gb}$ corresponding to the refraction angle $\theta_g$ is obtained is expressed by Formula 17 using the refractive index $n_r$ of the intermediate resin layer 123. Transforming Formula 17 into Formulas 18 and 19 yields Formula 20.

$$\frac{n_r}{n_g} = \tan\theta_{gb} = \frac{\sin\theta_{gb}}{\sqrt{1-\sin^2\theta_{gb}}} = \frac{\frac{n_s}{n_g}\frac{n_i}{n_s}\sin\theta_{igb}}{\sqrt{1-\left(\frac{n_s}{n_g}\frac{n_i}{n_s}\sin\theta_{igb}\right)^2}} = \frac{n_i\sin\theta_{igb}}{\sqrt{n_g^2-n_i^2\sin^2\theta_{igb}}} \quad \text{[Formula 17]}$$

$$\frac{n_r^2}{n_g^2} = \frac{n_i^2\sin^2\theta_{igb}}{n_g^2-n_i^2\sin^2\theta_{igb}} \quad \text{[Formula 18]}$$

$$n_r^2 n_g^2 = n_i^2(n_g^2+n_r^2)\sin^2\theta_{igb} \quad \text{[Formula 19]}$$

$$\theta_{igb} = \sin^{-1}\left(\frac{n_r n_g}{n_i\sqrt{n_g^2+n_r^2}}\right) \quad \text{[Formula 20]}$$

Because the phase of the vertical polarization is inverted at the Brewster angle, a preferable condition for the dielectric layer 41 in the case where $\theta_i$ is greater than or smaller than both of $\theta_{ib}$ and $\theta_{igb}$ is expressed by the same formula as Formula 13. If $\theta_i$ is equal to one of $\theta_{ib}$ and $\theta_{igb}$ or takes a value between $\theta_{ib}$ and $\theta_{igb}$, a preferable condition for the dielectric layer 41 is shifted by ($\lambda/2$) from the condition expressed by Formula 13.

More specifically, if $\theta_i$ is greater than or smaller than both of $\theta_{ib}$ and $\theta_{igb}$, Formulas 13 and 15 are preferably satisfied, and if $\theta_i$ is equal to one of $\theta_{ib}$ and $\theta_{igb}$ or takes a value between $\theta_{ib}$ and $\theta_{igb}$, Formulas 21 and 22 are preferably satisfied and Formulas 23 and 24 are derived respectively from Formulas 21 and 22.

$$L_{a-e} = \frac{\lambda}{2}(2N+1)+\delta \quad \text{[Formula 21]}$$

$$L_{b-d} = \lambda(M+1)+\delta' \quad \text{[Formula 22]}$$

$$\frac{\lambda}{2}\left(N+\frac{5}{8}\right) > d_s\sqrt{n_s^2-n_i^2\sin^2\theta_i} + d_g\sqrt{n_g^2-n_i^2\sin^2\theta_i} > \frac{\lambda}{2}\left(N+\frac{3}{8}\right) \quad \text{[Formula 23]}$$

$$\frac{\lambda}{2}\left(M+\frac{9}{8}\right) > d_g\sqrt{n_g^2-n_i^2\sin^2\theta_i} > \frac{\lambda}{2}\left(M+\frac{7}{8}\right) \quad \text{[Formula 24]}$$

As described above, the vehicle 1 includes the dielectric layer 41 that is located between the antenna part 21 and the windshield 12 and closely adheres to the surface of the windshield 12. The dielectric layer 41 has a refractive index that is lower than the refractive index of the innermost glass layer 121 of the windshield 12 and higher than the refractive index of the air. The dielectric layer 41 has a thickness that allows reflection of a transmission wave to be suppressed by interference between a reflected wave generated by reflection of the transmission wave on the interface 124 at which the innermost glass layer 121 and the intermediate resin layer 123 closely adhere to each other, and a reflected wave generated by reflection of the transmission wave on the surface 411. This structure will help reduce loss of the transmission wave passing through the windshield 12 and improve the efficiency of transmission and reception of radio waves.

The incident angle of the transmission wave on the reflection suppression layer 4 at the center of the main lobe of the transmitting antenna 211 is preferably greater than 10°. In other words, the windshield 12 may be inclined by a large amount with respect to the radiating surface of the transmitting antenna 211. Accordingly, it is possible to mount the radar device 11 on various parts of vehicles 1 in various designs.

Figure 8:
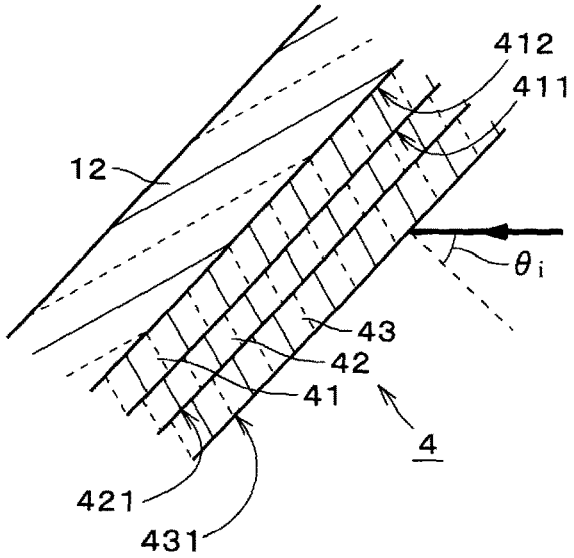
FIG. 8 is a cross-sectional view of a reflection suppression layer composed of a plurality of dielectric layers.

The reflection suppression layer 4 may include additional dielectric layers that closely adhere to the surface 411 on the antenna part 21 side of the dielectric layer 41. That is, the reflection suppression layer 4 is composed of at least one dielectric layer. In the example in FIG. 8, two dielectric layers 42 and 43 are stacked on top of each other on the surface 411 of the dielectric layer 41. The number of dielectric layers may be two, or may be four or more. Adjacent dielectric layers closely adhere to one another. The refractive index of the intermediate dielectric layer 42 is preferably lower than the refractive index of the outer dielectric layer 41 and higher than the refractive index of the air. The refractive index of the inner dielectric layer 43 is preferably lower than the refractive index of the dielectric layer 42 and higher than the refractive index of the air. In this way, the refractive indices of the dielectric layers gradually decrease as the positions of the dielectric layers are closer to the antenna part 21. This reduces reflection of the transmission wave on the interfaces.

Formula 13 given above is generally expressed by Formula 25, where m is an integer of 1 or more, m dielectric layers are stacked on top of one another in the reflection suppression layer 4, $d_{sj}$ is the thickness of the j-th dielectric layer counting from the antenna part 21 side, and $n_{sj}$ is the refractive index of the j-th dielectric layer. Formula 23 given above is generally expressed by Formula 26, where $n_s$ in Formula 16 given above for the Brewster angle condition is replaced by $n_{s1}$.

$$\frac{\lambda}{2}\left(N+\frac{9}{8}\right) > d_g\sqrt{n_g^2 - n_i^2 \sin^2\theta_i} + \sum_{j=1}^{m} d_{sj}\sqrt{n_{sj}^2 - n_i^2 \sin^2\theta_i} > \frac{\lambda}{2}\left(N+\frac{7}{8}\right) \quad \text{[Formula 25]}$$

$$\frac{\lambda}{2}\left(N+\frac{5}{8}\right) > d_g\sqrt{n_g^2 - n_i^2 \sin^2\theta_i} + \sum_{j=1}^{m} d_{sj}\sqrt{n_{sj}^2 - n_i^2 \sin^2\theta_i} > \frac{\lambda}{2}\left(N+\frac{3}{8}\right) \quad \text{[Formula 26]}$$

Preferably, each of the second and subsequent dielectric layers counting from the antenna part 21 side has a refractive index higher than the refractive index of a dielectric layer that is adjacent to the antenna part side of the second or subsequent dielectric layer. Every dielectric layer has a refractive index that is lower than the refractive index of the glass layer and higher than the refractive index of the air.

The reflection suppression layer 4 may be a single dielectric layer having a refractive index that gradually changes in the direction of thickness. The refractive index may gradually increase from the side of incidence toward the windshield 12. In this case, for example, the refractive index at a half-thickness position of the reflection suppression layer 4 is used as a representative value to determine the above-described conditions.

Figure 9:
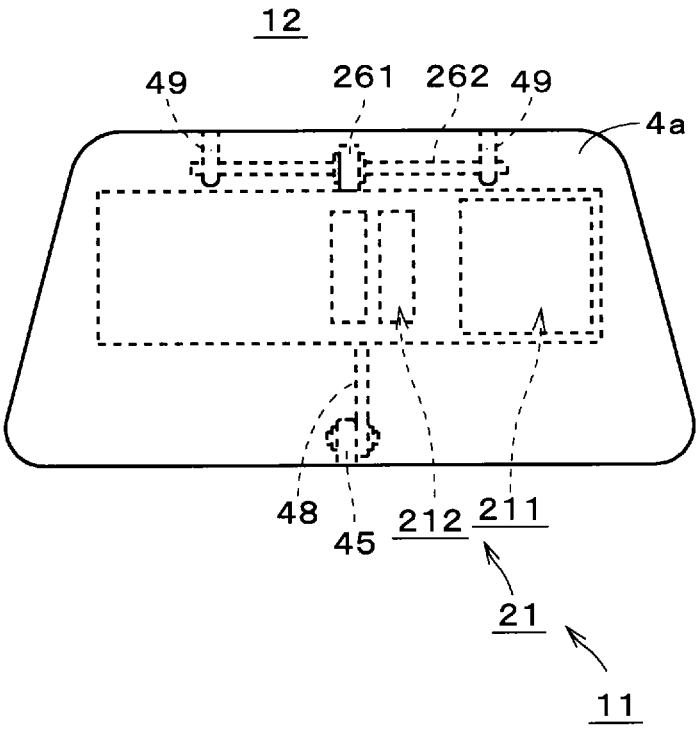
FIG. 9 is a front view showing another exemplary reflection suppression layer.
Figure 10:
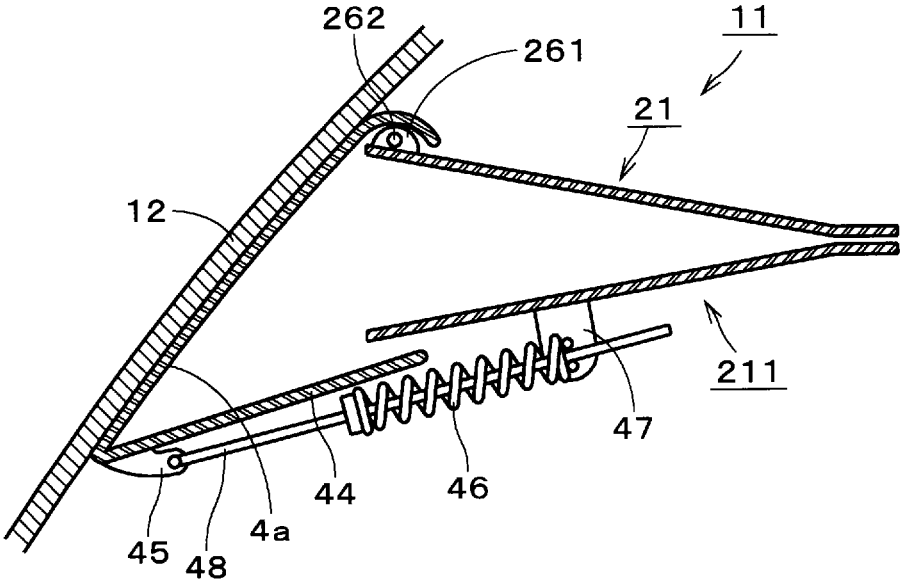
FIG. 10 is a cross-sectional view of the reflection suppression layer.

FIGS. 9 and 10 show another example of the reflection suppression layer, namely, a reflection suppression layer 4*a*, and illustrate part of the radar device 11 mounted on the windshield 12 and the reflection suppression layer 4*a*. FIGS. 9 and 10 correspond respectively to FIGS. 3 and 4.

The reflection suppression layer 4*a* includes at least one dielectric layer and has a plate-like shape. The reflection suppression layer 4*a* is located between the antenna part 21 and the windshield 12 and covers the front of the opening of the antenna part 21. The reflection suppression layer 4*a* also serves as an antenna cover of the radar device 11. In other words, the antenna cover also serves as the reflection suppression layer 4*a*. Hereinafter, the reflection suppression layer 4*a* is referred to as a "dielectric cover 4*a*." A dielectric layer(s) of the dielectric cover 4*a* may be made of an ABS resin, a polycarbonate resin, a syndiotactic polystyrene resin, or the like. The dielectric cover 4*a* has flexibility.

The dielectric cover 4*a* has two bearings 49. The two bearings 49 are fixed at the upper part to the surface on the antenna part 21 side of the dielectric cover 4*a*. The antenna part 21 has one bearing 261. The bearing 261 is provided at the upper part of the antenna part 21. The bearing 261 is located between the two bearings 49, which are arranged approximately in the horizontal direction. The two bearings 49 and the one bearing 261 share one shaft 262. Thus, the upper part of the dielectric cover 4*a* is rotatably supported on the upper part of the antenna part 21. For example, the angle of the dielectric cover 4*a* relative to the antenna part 21 may vary within a range of approximately ±10°. In actuality, the bearing 261 is arranged at a position that is in close proximity to the windshield 12, and the shaft 262 applies pressure toward the windshield 12 to the top part of the dielectric cover 4*a*.

The dielectric cover 4*a* includes a lower cover 44 and a rod 48. The lower cover 44 extends toward the bottom of the antenna part 21. The lower cover 44 includes a bearing 45. The bearing 45 is connected to one end of the rod 48. The bearing 45 rotatably supports the rod 48. The rod 48 is inserted in a coil spring 46. One end on the bearing 45 side of the coil spring 46 is fixed to the rod 48. The other end of the coil spring 46 is in contact with a supporter 47 provided on the bottom of the antenna part 21. The coil spring 46 applies pressure toward the windshield 12 to the bottom of the dielectric cover 4*a*. As a result, the dielectric cover 4*a* is brought into intimate contact with the surface on the antenna part 21 side of the windshield 12, while being bent.

A dielectric layer of the dielectric cover 4*a* that closely adheres to the surface on the antenna part 21 side of the windshield 12 has a thickness and a refractive index that allow reflection of a transmission wave to be suppressed by interference between the reflected wave generated by reflection of the transmission wave on the interface at which the innermost glass layer 121 and the intermediate resin layer 123 of the windshield 12 closely adhere to each other, and the reflected wave generated by reflection of the transmission wave on the surface on the antenna part 21 side of the dielectric layer. That is, the above-described conditions are satisfied.

Since the refractive indices of electromagnetic waves in the millimeter waveband differ greatly from those in the other frequency bands, the refractive indices of radio waves in the millimeter waveband have to be used to evaluate the formulas described above. The radio waves in the millimeter waveband as used herein refer to radio waves having wavelengths of 1 mm to 10 mm in the air.

The vehicle 1 described above may be modified in various ways.

The windshield 12 is not limited to three-layer laminated glass, and may be a single glass layer. In this case, the intermediate resin layer 123 in the above description is replaced by the air layer, and the refractive index of the air layer is used as the refractive index $n_r$ in the above conditions.

An object on which the radar device 11 is mounted is not limited to the windshield, and the radar device 11 may be mounted on the rear glass for the purpose of rearward monitoring. The installation position of the radar device is not limited to a position on glass.

The vehicle 1 is not limited to a passenger car and may be other vehicles, such as a truck or a train, for use in various applications. The vehicle 1 is not limited to a man-driven vehicle, and may be an unattended vehicle such as an automated guided vehicle used in a factory.

The configurations of the preferred embodiments and variations described above may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention. This application claims priority benefit under 35 U.S.C. Section 119 of Japanese Patent Application No. 2016-047838 filed in the Japan Patent Office on Mar. 11, 2016, the entire disclosure of which is incorporated herein by reference.

INDUSTRIAL AVAILABILITY

The vehicle according to the present invention can be used for various applications.

REFERENCE SIGNS LIST

1 Vehicle
4 Reflection suppression layer
4*a* Dielectric cover

10 Vehicle body
12 Windshield
13 Vehicle interior
15 Drive mechanism
21 Antenna part
32 Receiver
41 to 43 Dielectric layer
121 Innermost glass layer
312 High-frequency oscillator

The invention claimed is:

1. A vehicle comprising:

a vehicle body;

a drive mechanism for moving the vehicle body;

a windshield located between a vehicle interior and an outside, at least a surface on the vehicle interior side of the windshield being a surface of a glass layer;

an antenna part provided in the vehicle interior and for transmitting a transmission wave from the vehicle interior through the windshield to the outside, the transmission wave being a radio wave in a millimeter waveband, and receiving a reflected wave that enters the vehicle interior from the outside through the windshield;

a reflection suppression layer composed of at least one dielectric layer that closely adheres to the surface on the antenna part side of the windshield;

a high-frequency oscillator for outputting high-frequency electric power to the antenna part; and a receiver for receiving input of a radio wave received by the antenna part and outputting a received signal, wherein the at least one dielectric layer has a refractive index that is lower than a refractive index of the glass layer and higher than a refractive index of air, the transmission wave has a horizontal polarization component greater than a vertical polarization component thereof with respect to the reflection suppression layer, and Formula 27 is satisfied:

$$\frac{\lambda}{2}\left(M+\frac{5}{8}\right) > d_g\sqrt{n_g^2 - n_i^2\ \sin^2\ \theta_i} > \frac{\lambda}{2}\left(M+\frac{3}{8}\right) \quad \text{[Formula 27]}$$

and $$\frac{\lambda}{2}\left(N+\frac{9}{8}\right) > d_g\sqrt{n_g^2 - n_i^2\ \sin^2\ \theta_i} + \sum_{j=1}^{m} d_{sj}\sqrt{n_{sj}^2 - n_i^2\ \sin^2\ \theta_i} > \frac{\lambda}{2}\left(N+\frac{7}{8}\right)$$

where $\theta_i$ is an incident angle of the transmission wave on the reflection suppression layer at a center of a main lobe, $n_i$ is the refractive index of air, m is the number of the at least one dielectric layer, $d_{sj}$ is a thickness of a j-th dielectric layer counting from the antenna part side, $n_{sj}$ is a refractive index of the j-th dielectric layer, $d_g$ is a thickness of the glass layer, $n_g$ is a refractive index of the glass layer, $\lambda$ is a wavelength of the transmission wave in air, and M and N are integers of 0 or more.

2. The vehicle according to claim 1, wherein the variable j is 1.

3. The vehicle according to claim 2, further comprising:

an antenna cover located between the antenna part and the windshield and covering a front of the antenna part, wherein the antenna cover also serves as the reflection suppression layer.

4. The vehicle according to claim 1, wherein the variable j is greater than or equal to 2, and each of the second and subsequent dielectric layers counting from the antenna part side has a refractive index higher than a refractive index of a dielectric layer that is adjacent to the antenna part side of the dielectric layer.

5. The vehicle according to claim 4, wherein the incident angle of the transmission wave on the reflection suppression layer at the center of the main lobe is greater than 10 degrees.

6. The vehicle according to claim 4, further comprising:

an antenna cover located between the antenna part and the windshield and covering a front of the antenna part, wherein the antenna cover also serves as the reflection suppression layer.

7. The vehicle according to claim 1, wherein the incident angle of the transmission wave on the reflection suppression layer at the center of the main lobe is greater than 10 degrees.

8. The vehicle according to claim 7, further comprising:

an antenna cover located between the antenna part and the windshield and covering a front of the antenna part, wherein the antenna cover also serves as the reflection suppression layer.

9. The vehicle according to claim 2, wherein the incident angle of the transmission wave on the reflection suppression layer at the center of the main lobe is greater than 10 degrees.

10. The vehicle according to claim 1, further comprising:

an antenna cover located between the antenna part and the windshield and covering a front of the antenna part, wherein the antenna cover also serves as the reflection suppression layer.

11. A vehicle comprising:

a vehicle body;

a drive mechanism for moving the vehicle body;

a windshield located between a vehicle interior and an outside, at least a surface on the vehicle interior side of the windshield being a surface of a glass layer;

an antenna part provided in the vehicle interior and for transmitting a transmission wave from the vehicle interior through the windshield to the outside, the transmission wave being a radio wave in a millimeter waveband, and receiving a reflected wave that enters the vehicle interior from the outside through the windshield;

a reflection suppression layer composed of at least one dielectric layer that closely adheres to the surface on the antenna part side of the windshield;

a high-frequency oscillator for outputting high-frequency electric power to the antenna part; and a receiver for receiving input of a radio wave received by the antenna part and outputting a received signal, wherein the at least one dielectric layer has a refractive index that is lower than a refractive index of the glass layer and higher than a refractive index of air, the transmission wave has a vertical polarization component greater than a horizontal polarization component thereof with respect to the reflection suppression layer, and Formulas 28 and 29 are satisfied:

[Formula 28]

If $\theta_i$ is greater than or smaller than both of $$\sin^{-1}\left(\frac{n_r n_g}{n_i\sqrt{n_g^2+n_r^2}}\right) \text{ and } \tan^{-1}\frac{n_{s1}}{n_i},$$

$$\frac{\lambda}{2}\left(M+\frac{5}{8}\right) > d_g\sqrt{n_g^2-n_i^2\sin^2\theta_i} > \frac{\lambda}{2}\left(M+\frac{3}{8}\right)$$

and $$\frac{\lambda}{2}\left(N+\frac{9}{8}\right) > d_g\sqrt{n_g^2-n_i^2\sin^2\theta_i} + \sum_{j=1}^{m} d_{sj}\sqrt{n_{sj}^2-n_i^2\sin^2\theta_i} > \frac{\lambda}{2}\left(N+\frac{7}{8}\right)$$

[Formula 29]

If $\theta_i$ is a value between or equal to one of $$\sin^{-1}\left(\frac{n_r n_g}{n_i\sqrt{n_g^2+n_r^2}}\right) \text{ and } \tan^{-1}\frac{n_{s1}}{n_i},$$

$$\frac{\lambda}{2}\left(M+\frac{9}{8}\right) > d_g\sqrt{n_g^2-n_i^2\sin^2\theta_i} > \frac{\lambda}{2}\left(M+\frac{7}{8}\right)$$

and $$\frac{\lambda}{2}\left(N+\frac{5}{8}\right) > d_g\sqrt{n_g^2-n_i^2\sin^2\theta_i} + \sum_{j=1}^{m} d_{sj}\sqrt{n_{sj}^2-n_i^2\sin^2\theta_i} > \frac{\lambda}{2}\left(N+\frac{3}{8}\right)$$

where $\theta_i$ is an incident angle of the transmission wave on the reflection suppression layer at a center of a main lobe, $n_i$ is a refractive index of air, m is the number of the at least one dielectric layer, $d_{sj}$ is a thickness of a j-th dielectric layer counting from the antenna part side, $n_{sj}$ is a refractive index of the j-th dielectric layer, $d_g$ is a thickness of the glass layer, $n_g$ is a refractive index of the glass layer, $n_r$ is a refractive index of a dielectric layer or an air layer that is adjacent to an opposite side of the glass layer to the antenna part side, $\lambda$ is a wavelength of the transmission wave in air, and M and N are integers of 0 or more.

12. The vehicle according to claim 11, wherein the variable j is 1.

13. The vehicle according to claim 12, further comprising: an antenna cover located between the antenna part and the windshield and covering a front of the antenna part, wherein the antenna cover also serves as the reflection suppression layer.

14. The vehicle according to claim 11, wherein the variable j is greater than or equal to 2, and each of the second and subsequent dielectric layers counting from the antenna part side has a refractive index higher than a refractive index of a dielectric layer that is adjacent to the antenna part side of the dielectric layer.

15. The vehicle according to claim 14, wherein the incident angle of the transmission wave on the reflection suppression layer at the center of the main lobe is greater than 10 degrees.

16. The vehicle according to claim 14, further comprising: an antenna cover located between the antenna part and the windshield and covering a front of the antenna part, wherein the antenna cover also serves as the reflection suppression layer.

17. The vehicle according to claim 11, wherein the incident angle of the transmission wave on the reflection suppression layer at the center of the main lobe is greater than 10 degrees.

18. The vehicle according to claim 17, further comprising: an antenna cover located between the antenna part and the windshield and covering a front of the antenna part, wherein the antenna cover also serves as the reflection suppression layer.

19. The vehicle according to claim 12, wherein the incident angle of the transmission wave on the reflection suppression layer at the center of the main lobe is greater than 10 degrees.

20. The vehicle according to claim 11, further comprising: an antenna cover located between the antenna part and the windshield and covering a front of the antenna part, wherein the antenna cover also serves as the reflection suppression layer.

* * * * *